US011274674B2

(12) United States Patent
Morimura et al.

(10) Patent No.: US 11,274,674 B2
(45) Date of Patent: Mar. 15, 2022

(54) AIR COMPRESSOR

(71) Applicant: MAX CO., LTD., Tokyo (JP)

(72) Inventors: Takashi Morimura, Tokyo (JP); Takuya Osawa, Tokyo (JP)

(73) Assignee: MAX CO., LTD., Tokyo (JP)

( * ) Notice: Subject to any disclaimer, the term of this patent is extended or adjusted under 35 U.S.C. 154(b) by 0 days.

(21) Appl. No.: 16/857,332

(22) Filed: Apr. 24, 2020

(65) Prior Publication Data

US 2020/0378394 A1 Dec. 3, 2020

(30) Foreign Application Priority Data

Apr. 25, 2019 (JP) ..... JP2019-083966

(51) Int. Cl.
*F04D 25/06* (2006.01)
*F04B 49/02* (2006.01)
*F04D 27/00* (2006.01)

(52) U.S. Cl.
CPC ..... *F04D 27/004* (2013.01); *F04B 49/022* (2013.01); *F04D 25/06* (2013.01)

(58) Field of Classification Search
CPC ..... F04D 25/06; F04D 27/004; F04B 49/022
See application file for complete search history.

(56) References Cited

U.S. PATENT DOCUMENTS 6,287,083 B1 * 9/2001 Hase ..... F04B 41/06 417/2
8,257,053 B2 * 9/2012 Hase ..... F04B 41/06 417/44.2
2004/0191073 A1 9/2004 Iimura et al.
2006/0110258 A1 5/2006 Iimura et al.
2007/0077151 A1 * 4/2007 Hirasawa ..... F04B 41/06 417/5
2009/0288849 A1 11/2009 Iimura et al.
2011/0206538 A1 * 8/2011 Yokota ..... F04B 49/00 417/1
2018/0372086 A1 * 12/2018 Yashiki ..... F04B 49/10
2021/0080163 A1 * 3/2021 Fujita ..... F25B 49/022

FOREIGN PATENT DOCUMENTS

EP 3128171 A1 8/2017
JP 4009949 B2 9/2007
JP 2010024845 A * 2/2010 ..... F04B 41/06
JP 4690694 B2 2/2011
JP 2011-027068 A 10/2011
JP 2004-116462 A 4/2015

OTHER PUBLICATIONS

The Extended European Search Report mailed in corresponding EP Patent Application No. 20171239.5 dated Jul. 20, 2020 (7 pages).

* cited by examiner

*Primary Examiner* — Patrick Hamo
(74) *Attorney, Agent, or Firm* — Weihrouch IP

(57) ABSTRACT

An air compressor includes a motor, a compression mechanism configured to be driven by the motor to generate compressed air, a tank configured to store the compressed air, a controller configured to control driving of the motor, an air extraction port configured to extract compressed air from the tank, and an extraction pressure sensor configured to measure an extraction pressure that is a pressure of compressed air extracted from the air extraction port. The controller is configured to control the driving of the motor by referring to the extraction pressure.

10 Claims, 12 Drawing Sheets

AIR COMPRESSOR

CROSS-REFERENCE TO RELATED APPLICATION

This application claims priority from Japanese Patent Application No. 2019-83966 filed on Apr. 25, 2019, the entire contents of which are incorporated herein by reference.

TECHNICAL FIELD

Aspects of the present invention relate to an electric air compressor, and particularly, to a compression mechanism that dynamically changes control of a motor in accordance with air consumption amount.

BACKGROUND

An air compressor changes control of a motor in accordance with air consumption amount such that when the air consumption amount is small, a rotational speed of the motor is reduced to improve quietness and save electric power, and when the air consumption amount is large, the rotational speed of the motor is increased to increase discharge amount of compressed air to prevent lack of compressed air in the tank. Further, an air compressor can change a pressure value (ON pressure value) in a tank for restarting a motor and a pressure value (OFF pressure value) in the tank for stopping the motor so as to adjust an amount of compressed air stored in the tank.

For example, JP4009949B discloses an air compressor that calculates a tank internal pressure and a pressure change rate in a predetermined time, and determines a rotational speed of a motor from at least one of the tank internal pressure and the pressure change rate.

JP4690694 discloses an air compressor that calculates a tank internal pressure and a pressure change rate in a predetermined time, and sets a pressure value in a tank for stopping a motor based on the pressure change rate.

In the meantime, in an air compressor, even when air is used on a tool side, an influence thereof does not immediately appear in a tank internal pressure. Therefore, when the control of the motor is performed in accordance with the tank internal pressure as described in JP4009949B, a response to a pressure change on the tool side may be delayed. Particularly, in a case where a tank capacity is large, a ratio of air consumption amount to the tank capacity is small as compared with a case where the tank capacity is small. Therefore, when air is consumed in an air compressor having a large tank capacity, a response of a pressure change in a tank internal pressure becomes slow, followability to actual air consumption amount is deteriorated, a rotational speed of a motor cannot be sufficiently increased, and a tank internal pressure may become insufficient.

Even when the followability to the air consumption amount is sufficient, the tank internal pressure tends to be influenced by external factors, so that a detection value may vary. For example, a value of the tank internal pressure may fluctuate due to external factors such as a driving state of the motor (whether the motor is stopped), the rotational speed of the motor, a temperature of the air compressor, a deterioration state of the air compressor. Therefore, the actual air consumption may not be accurately grasped.

SUMMARY

Accordingly, the present invention has been made in view of the above circumstances, an object thereof is to provide an air compressor that can accurately grasp a usage status of compressed air without using a tank internal pressure and can improve followability of control to the usage status of compressed air.

According to an illustrative embodiment of the present invention, there is provided an air compressor including: a motor; a compression mechanism configured to be driven by the motor to generate compressed air; a tank configured to store the compressed air; a controller configured to control driving of the motor; an air extraction port configured to extract compressed air from the tank; and an extraction pressure sensor configured to measure an extraction pressure that is a pressure of compressed air extracted from the air extraction port, wherein the controller is configured to control the driving of the motor by referring to the extraction pressure.

According to the above configuration, the air compressor includes the extraction pressure sensor configured to measure the extraction pressure of compressed air extracted from the air extraction port. The controller is configured to control the motor by referring to the extraction pressure. Accordingly, when air is used on a tool side, the use of air can be directly detected by the extraction pressure sensor. Therefore, a usage status of compressed air can be accurately grasped without being influenced by the tank internal pressure that may fluctuate due to external factors.

Further, the air compressor can directly refers to the usage status of compressed air and use the usage status of compressed air for control, so that followability of control to the usage status of compressed air can be improved.

DETAILED DESCRIPTION (First Embodiment) A first embodiment of the present invention will be described with reference to the attached drawings.

Figure 1:
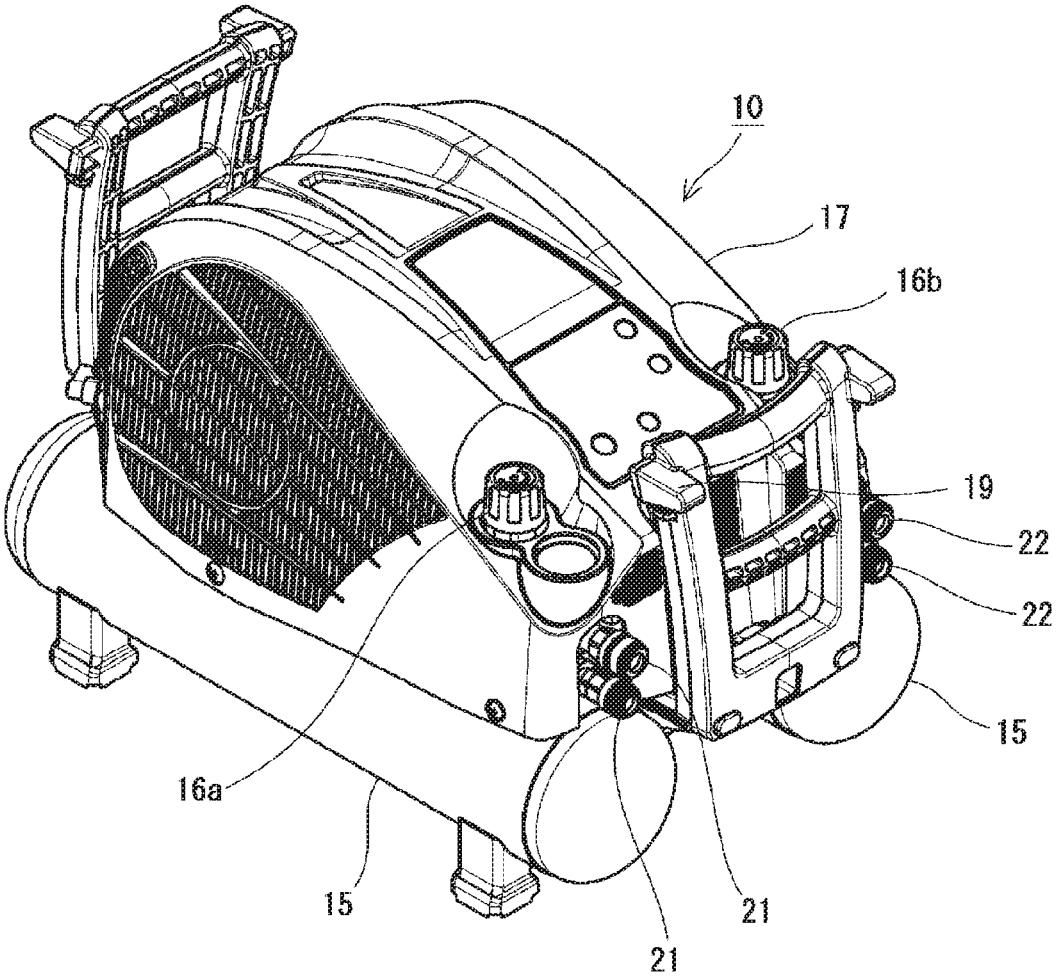
FIG. 1 is an external view of an air compressor.

An air compressor 10 according to the present embodiment is a portable compressor. As shown in FIG. 1, the air compressor 10 includes a mechanism portion covered by a main body cover 17 and two tanks 15 arranged below the mechanism portion.

Figure 2:
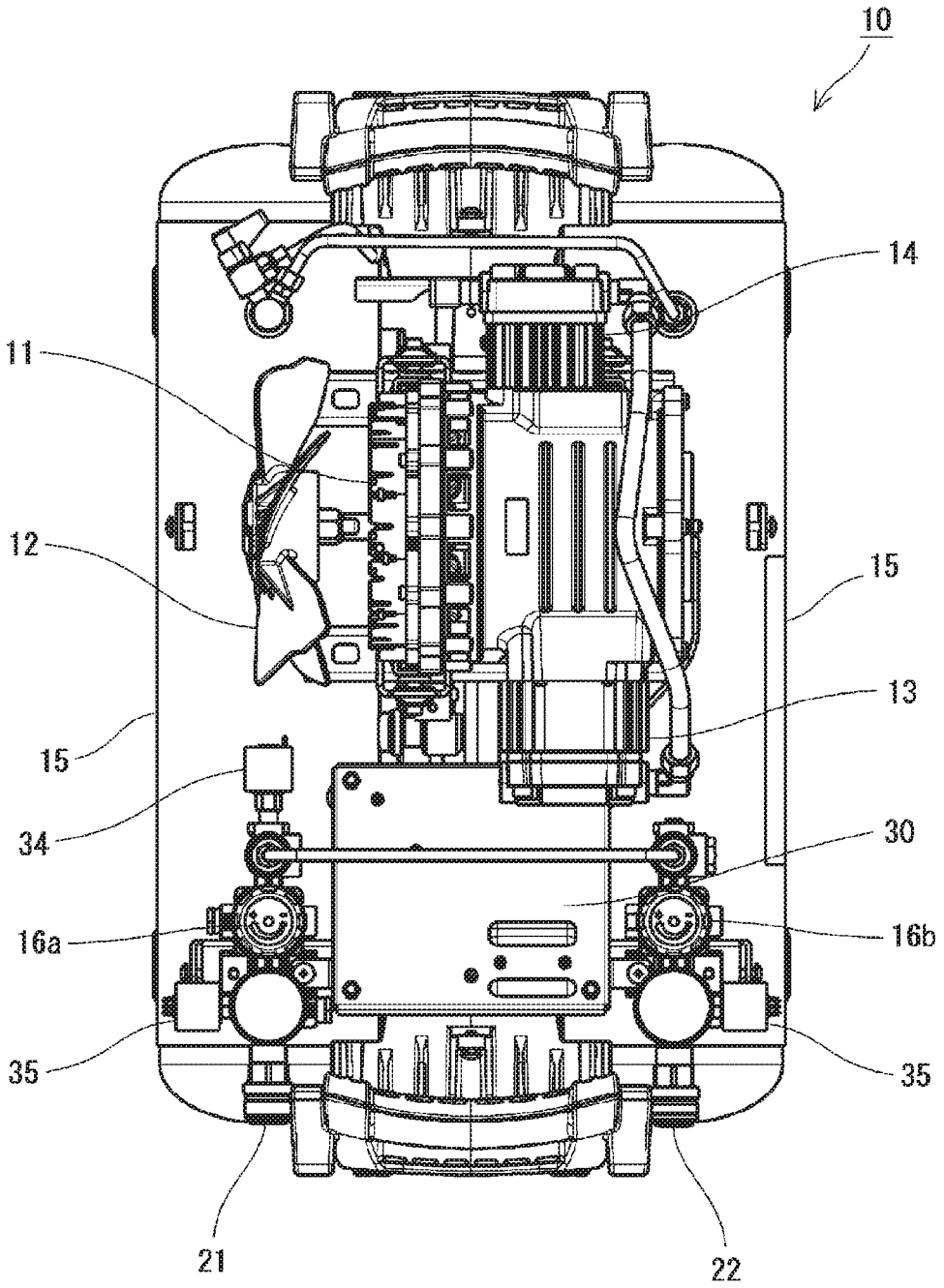
FIG. 2 is a plan view of the air compressor in which a main body cover is removed.

As shown in FIG. 2, the mechanism portion includes a motor 11, a fan 12, a compression mechanism, a control board (controller 30) and the like.

The motor 11 is an inner-rotor-type three-phase brushless DC motor in which a rotor is disposed on an inner side of an annular stator. Rotation of the motor 11 is controlled by a PWM signal output from the controller 30 (described below). The motor 11 includes a position sensor 36 (described below).

The fan 12 introduces cooling air into an inside of the mechanism portion to cool a heat generating component such as the motor 11. The fan 12 is fixed to a rotation shaft of the motor 11 and is rotated integrally when the motor 11 is driven.

The compression mechanism is driven by the motor 11 to generate compressed air and may have a known structure that reciprocates a piston to compress air introduced into a cylinder. The air compressor 10 according to the present embodiment is a multi-stage compressor including two compression mechanisms, i.e. a primary compression mechanism 13 and a secondary compression mechanism 14. That is, air supplied from outside is first compressed by the primary compression mechanism 13. The air compressed by the primary compression mechanism 13 is introduced into the secondary compression mechanism 14 and further compressed by the secondary compression mechanism 14. Accordingly, air compressed in two stages is sent to the tanks 15 and stored therein. As the air stored in the tanks 15, an internal pressure of the tanks 15 may reach about 4.4 MPa. When a capacity of the tanks 15 in the present embodiment is, for example, 11 liters, about 490 liters of air may be stored.

The tanks 15 store compressed air generated by the compression mechanism. The air compressor 10 according to the present embodiment includes two tanks 15. The two tanks 15 are arranged in parallel to each other along a longitudinal direction of the air compressor 10.

Compressed air stored in the tanks 15 can be decompressed to an arbitral pressure by passing through decompression valves 16*a* and 16*b*, and can be extracted to outside from air extraction ports. For example, compressed air in the tanks 15 can be supplied to a tool by connecting air hoses of the tool such as a nailing machine, a spray gun, or an air duster to the air extraction ports.

In the present embodiment, as shown in FIG. 1, the decompression valves 16*a* and 16*b* are arranged at two positions respectively on left and right sides, and first air couplers 21 and second air couplers 22 are arranged as the air extraction ports downstream of the decompression valves 16*a* and 16*b*. These air couplers protrude outward from a front surface of the main body cover 17. The air couplers are female couplers and allow corresponding male couplers to be easily attached thereto or detached therefrom. Therefore, air hoses with the male couplers are attached to the female couplers (air extraction ports), so that compressed air stored in the air compressor 10 can be extracted via the air hoses.

One decompression valve 16*a* can adjust an extraction pressure to an arbitral value between 0 and 1.0 MPa, and a low-pressure tool, which is generally used at about 0.8 MPa, is connected to the first air couplers 21 connected to the decompression valve 16*a*.

The other decompression valve 16*b* can adjust an extraction pressure to an arbitral value between 0 and 2.5 MPa, and a high-pressure tool, which is generally used at about 2.0 MPa, is connected to the second air couplers 22.

In the present embodiment, insides of the two tanks 15 communicate with each other, and the decompression valves 16*a* and 16*b* and the air extraction ports (first air couplers 21 and second air couplers 22) are respectively provided on the two tanks 15.

Operation of the air compressor 10 is controlled by the controller 30 disposed in the air compressor 10. Although not specifically shown, the controller 30 is mainly configured with a CPU and includes a ROM, a RAM, an I/O and the like. The CPU reads programs stored in the ROM to control various types of input devices and output devices. In the present embodiment, as shown in FIG. 2, the controller 30 is configured with a control board disposed above the tanks 15.

Figure 3:
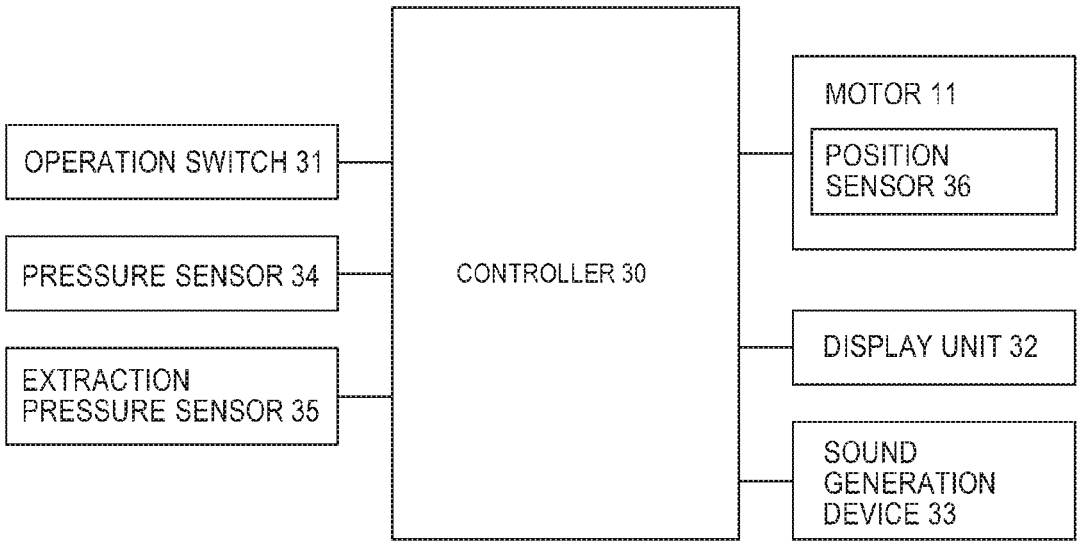
FIG. 3 is a block diagram showing a system of the air compressor.

As input devices of the controller 30, an operation switch 31, a pressure sensor 34, an extraction pressure sensor 35 and the position sensor 36 are provided as shown in FIG. 3. The input devices are not limited to these input devices, and other input devices may be provided.

The operation switch 31 includes various switches that can be operated by a user. Although not described in detail here, for example, a plurality of types of operation switches 31 such as a switch that turns on and off a power supply and a switch that switches an operation mode may be provided. The operation switch 31 is operably disposed on an operation panel 19 (see FIG. 1) provided on a front surface of the main body cover 17.

The pressure sensor 34 measures the internal pressure of the tanks 15. Pressure values detected by the pressure sensor 34 are transmitted to the controller 30. The controller 30 controls start and stop of driving of the motor 11 based on the pressure values obtained from the pressure sensor 34. Specifically, an ON pressure value that is a pressure value for starting driving of the compression mechanism and an OFF pressure value that is a pressure value for stopping driving of the compression mechanism are determined in advance such that the ON pressure value is smaller than the OFF pressure value. Then, the controller 30 performs control to drive the motor 11 when an internal pressure of the tank 15 is equal to or lower than the predetermined ON pressure value and to stop the motor 11 when the internal pressure of the tank 15 is equal to or higher than the predetermined OFF pressure value. Accordingly, when the internal pressure of the tank 15 does not reach the predetermined ON pressure value, the motor 11 is driven to fill compressed air, and when the internal pressure of the tank 15 reaches the predetermined OFF pressure value during the driving of the motor 11, the driving of the motor 11 is stopped.

The ON pressure value and the OFF pressure value of the air compressor 10 according to the present embodiment can be dynamically changed in accordance with a usage status of compressed air. As the ON pressure value and the OFF pressure value are dynamically changed, a level of the internal pressure of the tank 15, driving time of the motor 11 and the like can be controlled. For example, when the ON pressure value and the OFF pressure value are set to be high, control for maintaining the internal pressure of the tank 15 at a high level will be performed. On the contrary, when the ON pressure value and the OFF pressure value are set to be low, although the internal pressure of the tank 15 is not so high, the driving of the motor 11 can be suppressed to improve quietness and reduce power consumption.

In the present embodiment, the extraction pressure sensors 35 are disposed between the decompression valves 16*a* and 16*b* and the air extraction ports (that is, disposed downstream of the decompression valves 16*a* and 16*b*) and measure an extraction pressure of compressed air to be extracted from the air extraction ports. The pressure value detected by the extraction pressure sensors 35 is transmitted to the controller 30. The controller 30 controls the motor 11 by referring to the pressure value obtained from the extraction pressure sensors 35. The decompression valves 16*a* and 16*b* themselves may be provided with the extraction pressure sensors 35.

Figure 4:
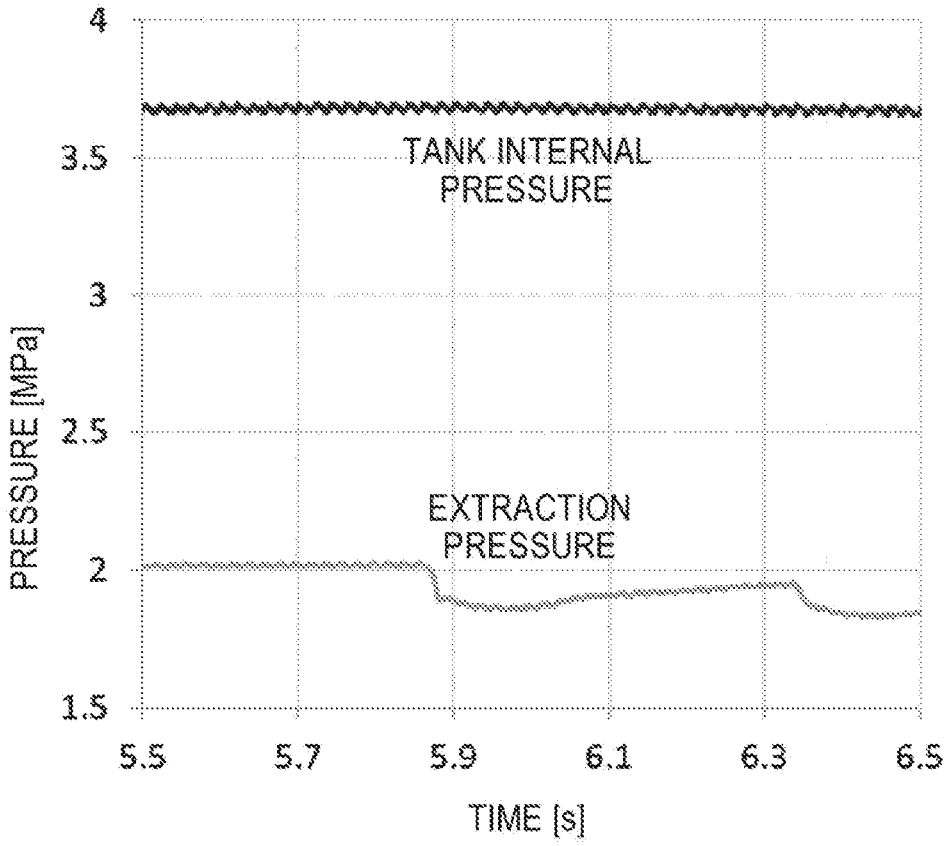
FIG. 4 is a graph showing a relationship between a tank internal pressure and an extraction pressure during use of a tool.

Although specific contents of the control will be described in detail below, the air compressor 10 according to the present embodiment controls the motor 11 by using the detected value of the extraction pressure sensors 35, so that followability of control to a usage status of compressed air can be improved as compared with the related-art control that uses a detected value of the pressure sensor 34. For example, FIG. 4 is an example of a graph showing a fluctuation in the internal pressure (detected value of the pressure sensor 34) and the extraction pressure (detected value of the extraction pressure sensors 35) of the tanks 15 when compressed air is used on a tool side connected to the air compressor 10. As shown in the graph, when air is used on the tool side, a pressure change clearly appears in the extraction pressure, whereas an influence on the internal pressure of the tank 15 does not appear immediately. As can be seen from the graph, even use of compressed air that cannot be detected by the pressure sensor 34 in the related art can be detected by the extraction pressure sensors 35. Therefore, by using the extraction pressure sensors 35, a usage status of compressed air can be accurately and sensitively detected, and followability of control to the usage status of the compressed air is improved.

The position sensor 36 detects a rotational position of the motor 11. The position sensor 36 is configured with a Hall IC or the like and outputs a signal to the controller 30 when rotation of the motor 11 (rotor) is detected. The controller 30 analyzes the signal from the position sensor 36 to calculate a rotational speed (rpm) of the motor 11.

The controller 30 according to the present embodiment uses the position sensor 36 to perform feedback control so as to keep the rotational speed of the motor 11 constant. Specifically, a supply voltage to the motor 11 is controlled to maintain a predetermined target rotational speed, and a rotational speed of the motor 11 grasped by the position sensor 36 and the target rotational speed are periodically compared, so that an output of the motor 11 is adjusted.

The controller 30 of the air compressor 10 according to the present embodiment includes an inverter circuit and a converter circuit (not shown). The converter circuit performs pulse amplitude modulation (PAM) control. The PAM control is a method for controlling the rotational speed of the motor 11 by changing a height of a pulse of an output voltage by the converter circuit. On the other hand, the inverter circuit performs pulse width modulation (PWM) control. The PWM control is a method for controlling the rotational speed of the motor 11 by changing a pulse width of an output voltage.

Compared with the PWM control, the PAM control is a control method mainly used during a high output and steady operation because the PAM control has a characteristic that efficiency of the motor 11 during low speed rotation is less reduced and that high speed rotation can be controlled by increasing a voltage. On the other hand, the PWM control is a control method mainly used during start-up, voltage reduction and the like. Although the controller 30 performs control by suitably switching between the PAM control based on the converter circuit and the PWM control based on the inverter circuit in accordance with an operation state of the air compressor 10, the control method is not limited thereto.

The target rotational speed of the air compressor 10 according to the present embodiment can be dynamically changed in accordance with a usage status of the compressed air. As the target rotational speed is set to be high, the motor 11 can be driven at a high speed to increase a filling speed of compressed air. On the other hand, as the target rotational speed is set to be low, since the motor 11 is driven at a low speed, although the filling speed of compressed air is reduced, the quietness can be improved.

As the output devices of the controller 30, the motor 11, a display unit 32 and a sound generation device 33 are provided as shown in FIG. 3. The output devices are not limited to these output devices, and other output devices may be provided.

The motor 11 serves as a power source for operating the compression mechanism as described above. The controller 30 controls the rotation of the motor 11 by the PWM control.

The display unit 32 displays various types of information to the user. For example, the display unit 32 is a display device such as a seven-segment display, a liquid crystal screen, or an LED. The display unit 32 according to the present embodiment is provided on the operation panel 19 provided on the front surface of the main body cover 17.

The sound generation device 33 outputs various types of sounds to the user. For example, the sound generation device 33 is a device such as a speaker or a buzzer. The sound generation device 33 according to the present embodiment outputs a warning sound when, for example, some error occurs.

As described above, the controller 30 according to the present embodiment controls the motor 11 by referring to the extraction pressure detected by the extraction pressure sensors 35. Specifically, the target rotational speed of the motor 11 is changed by referring to the extraction pressure, and the ON pressure value and the OFF pressure value are changed with reference to the extraction pressure.

Although in the present embodiment, three values, that is, the target rotational speed, the ON pressure value and the OFF pressure value are changed by referring to the extraction pressure, the present invention is not limited thereto, and only one or two of these values may be changed. That is, at least one of the target rotational speed, the ON pressure value and the OFF pressure value may be changed by referring to the extraction pressure.

The air compressor 10 in the present embodiment controls an AC current from an AC power supply, which serves as a power supply, as a control current used for driving control of the motor 11 with an upper limit of 15A. In the present embodiment, the controller 30 can change an AC current value, which is the control current, within a range not exceeding the upper limit value 15A by referring to the extraction pressure of the extraction pressure sensors 35.

In addition to the operation mode in which at least one of the target rotational speed, the ON pressure value and the OFF pressure value is changed by referring to the extraction pressure, an operation mode in which the target rotational speed, the ON pressure value and the OFF pressure value are not changed may be provided. For example, an operation mode in which the target rotational speed, the ON pressure value and the OFF pressure value are always kept constant, and an operation mode in which the target rotational speed, the ON pressure value and the OFF pressure value are changed in accordance with the extraction pressure may be provided, and the user may select and set which mode to operate.

A plurality of operation modes may be provided as the operation mode in which the target rotational speed, the ON pressure value and the OFF pressure value are always kept constant, and the plurality of operation modes may be switched by the user in accordance with a purpose of use. For example, a first operation mode in which the ON pressure value is 2.5 MPa, the OFF pressure value is 3.0 MPa and the target rotational speed of the motor 11 is 1,800 rpm, and a second operation mode in which the ON pressure value is 3.9 MPa, the OFF pressure value is 4.4 MPa and the target rotational speed of the motor 11 is 3,000 rpm may be provided, and the user can select and set one of at least these two modes by operating the operation switch 31. According to this configuration, the first mode can be selected when the rotational speed of the motor 11 is to be reduced to suppress a sound generated during operation, and the second mode can be selected when the rotational speed of the motor 11 is to be increased to increase a discharge amount of compressed air generated by the compression mechanism.

Figure 5:
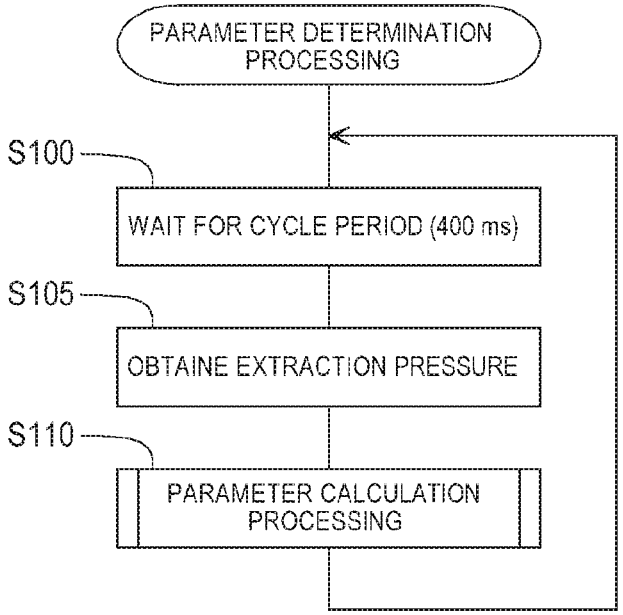
FIG. 5 is a flowchart of a parameter determination processing.
Figure 7:
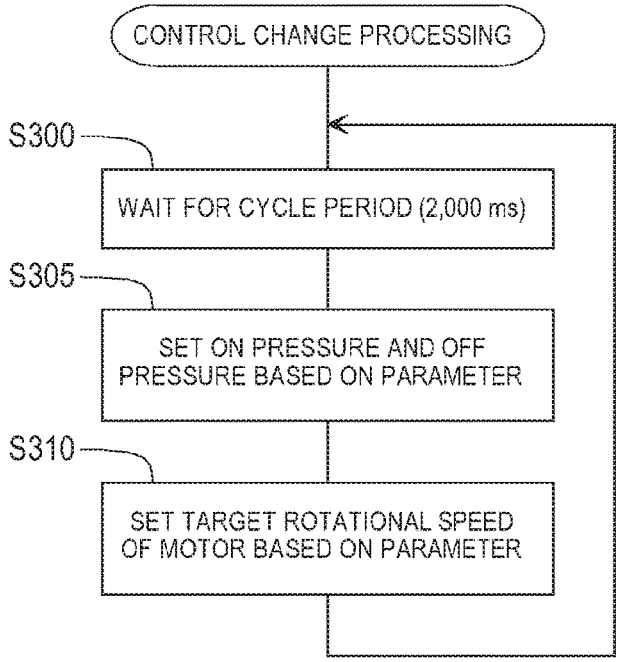
FIG. 7 is a flowchart of a control change processing.

A processing of the controller 30 that changes these values is executed by combining a parameter determination processing as shown in FIG. 5 and a control change processing as shown in FIG. 7. The parameter determination processing and the control change processing are periodically executed at constant time intervals, for example, by being registered in a periodic handler.

First, the parameter determination processing will be described with reference to FIGS. 5 and 6. The parameter determination processing is a processing of determining a parameter for controlling the motor 11 by referring to an extraction pressure detected by the extraction pressure sensors 35.

In the parameter determination processing, first, in step S100 shown in FIG. 5, the processing waits until a cycle period for executing the processing arrives. Since the parameter determination processing according to the present embodiment is periodically executed every 400 ms, the processing waits until 400 ms has elapsed from previous execution. Then, the processing proceeds to step S105.

In step S105, the extraction pressure detected by the extraction pressure sensors 35 is obtained. Then, the processing proceeds to step S110.

In step S110, the parameter calculation processing (described below) is executed, and a parameter for changing control of the motor 11 is set. As one parameter determination processing is completed as described above, the processing returns to step S100 and waits until a next parameter determination processing starts.

Figure 6:
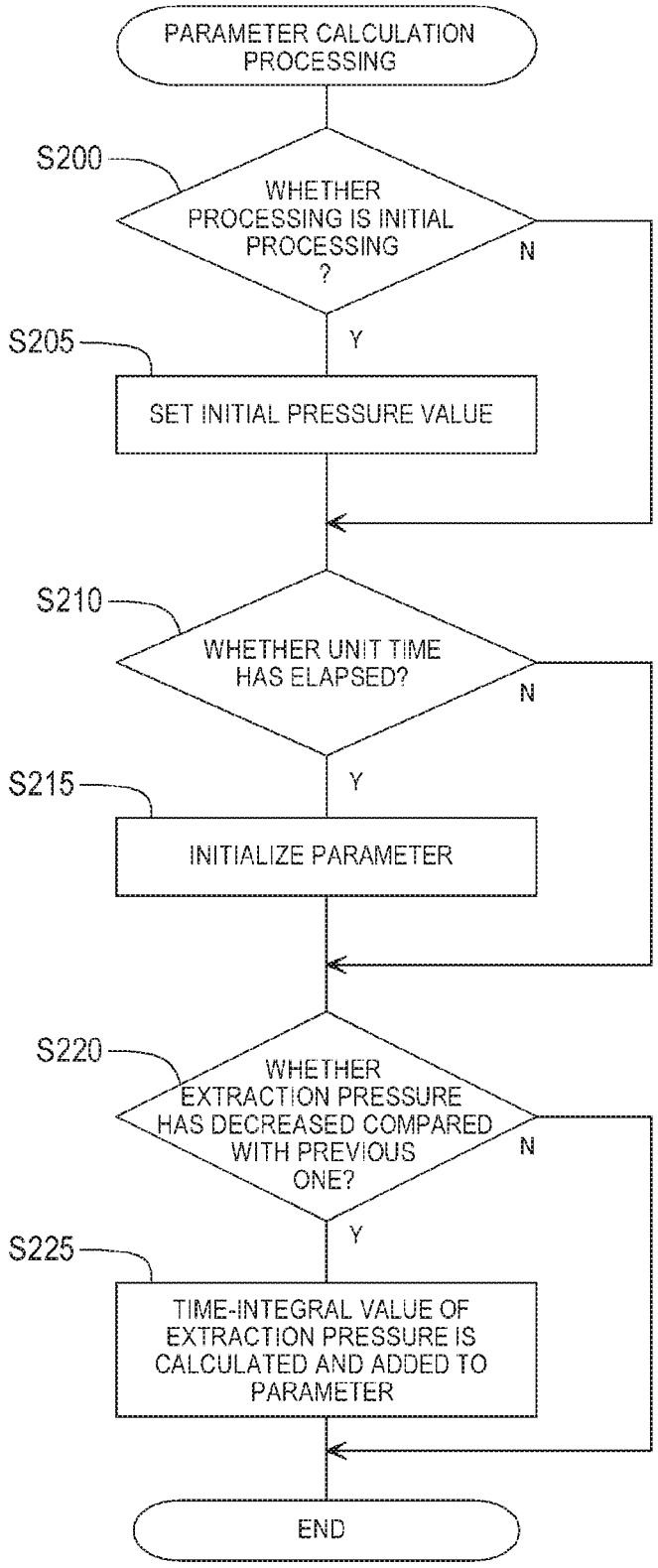
FIG. 6 is a flowchart of a parameter calculation processing.

FIG. 6 is a flowchart of the parameter calculation processing according to the present embodiment. In the parameter calculation processing, air consumption amount is estimated based on a time-integral value of the extraction pressure, and the air consumption amount within a certain period of time is set as a parameter. The controller 30 according to the present embodiment changes the control of the motor 11 in accordance with the air consumption amount estimated in the parameter calculation processing.

In the parameter calculation processing, first, in step S200 shown in FIG. 6, it is checked whether the processing is an initial processing (whether an initial pressure value is set). When the processing is the initial processing, the processing proceeds to step S205. On the other hand, when the processing is not the initial processing, the processing proceeds to step S210.

When the processing proceeds to step S205, it is determined that a current extraction pressure detected by the extraction pressure sensors 35 is an extraction pressure in an unused state where a tool is not operated, and the current extraction pressure is set as the initial pressure value. Then, the processing proceeds to step S210.

In step S210, it is checked whether a unit time for measuring the parameter has elapsed. That is, in the parameter calculation processing according to the present embodiment, since air consumption amount per unit time (for example, 400 ms) is calculated as a parameter, the parameter is reset every unit time. When the unit time has elapsed, the processing proceeds to step S215. On the other hand, when the unit time has not elapsed, the processing proceeds to step S220.

When the processing proceeds to step S215, the parameter is reset to "0". Then, the processing proceeds to step S220.

In step S220, a latest extraction pressure is compared with an extraction pressure used in a previous parameter calculation processing (previous extraction pressure), and it is checked whether the extraction pressure has decreased. When the extraction pressure has decreased, it is determined that compressed air is used by the tool side, and the processing proceeds to step S225. On the other hand, when the extraction pressure has not decreased, it is determined that compressed air is not used on the tool side, and the processing ends.

At step S220, the latest extraction pressure is saved as the "previous extraction pressure". Accordingly, the "previous extraction pressure" may be referred to in a next parameter calculation processing.

When the processing proceeds to step S225, the time-integral value of the extraction pressure is calculated so as to calculate the air consumption amount. The air consumption amount is added to the parameter to be a value per unit time. Then, the processing ends. The time-integral value of the extraction pressure corresponds to an amount of change (decrease amount) in the internal pressure of the tanks 15. The amount of change in the internal pressure of the tanks 15 corresponds to air consumption amount of the tanks 15. The air consumption amount may also be converted into a volume (liter or the like) by the controller 30 performing calculation based on the time-integral value of the extraction pressure and the capacity of the tanks 15.

Next, the control change processing will be described with reference to FIG. 7. The control change processing is a processing of changing the control of the motor 11 by using the parameter determined in the parameter determination processing. In the present embodiment, the control change processing is executed independently of the parameter determination processing (parameter calculation processing). The parameter determination processing and the control change processing may also be a series of control.

In the control change processing, first, in step S300 shown in FIG. 7, the processing waits until a cycle period for executing the processing arrives. Since the control change processing according to the present embodiment is periodically executed every 2,000 ms, the processing waits until 2,000 ms has elapsed from previous execution. Then, the processing proceeds to step S305.

In step S305, the ON pressure value and the OFF pressure value are set based on the parameter determined in the parameter determination processing. Then, the processing proceeds to step S310.

In step S310, the target rotational speed of the motor 11 is set based on the parameter determined in the parameter determination processing. Then, the processing ends.

In order to determine the ON pressure value, the OFF pressure value and the target rotational speed based on the parameter, a conversion table or a calculation formula may be prepared in advance, the parameter may be substituted in the conversion table or the calculation formula, and the ON pressure value, the OFF pressure value and the target rotational speed may be calculated.

Figure 8:
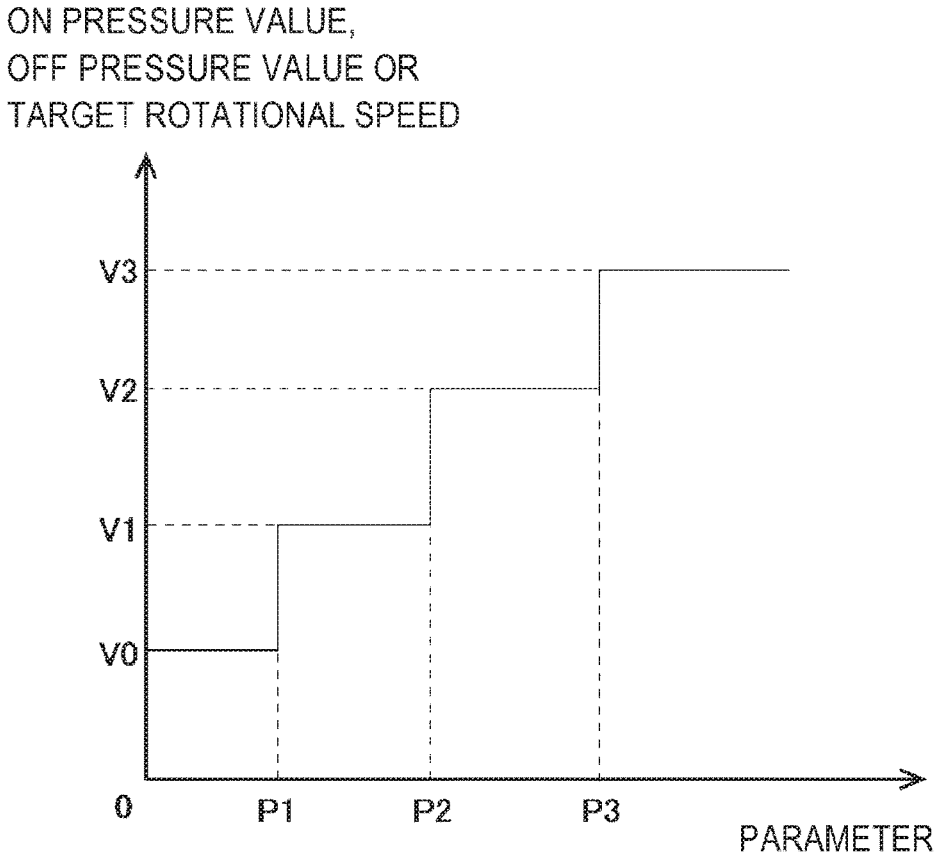
FIG. 8 is a diagram showing a relationship between a parameter and an ON pressure, an OFF pressure or a target rotational speed.

For example, using a relationship as shown in FIG. 8, the ON pressure value, the OFF pressure value and a value of the target rotational speed may be increased stepwise as a parameter value increases. In the example of FIG. 8, when the parameter value is "0 or more and smaller than P1", the ON pressure value (or the OFF pressure value or the target rotational speed) is determined to be "V0". When the parameter value is "P1 or more and smaller than P2", the ON pressure value (or the OFF pressure value or the target rotational speed) is determined to be "V1". When the parameter value is "P2 or more and smaller than P3", the ON pressure value (or the OFF pressure value or the target rotational speed) is determined to be "V2". When the parameter value is "P3 or more", the ON pressure value (or the OFF pressure value or the target rotational speed) is determined to be "V3".

Figure 9:
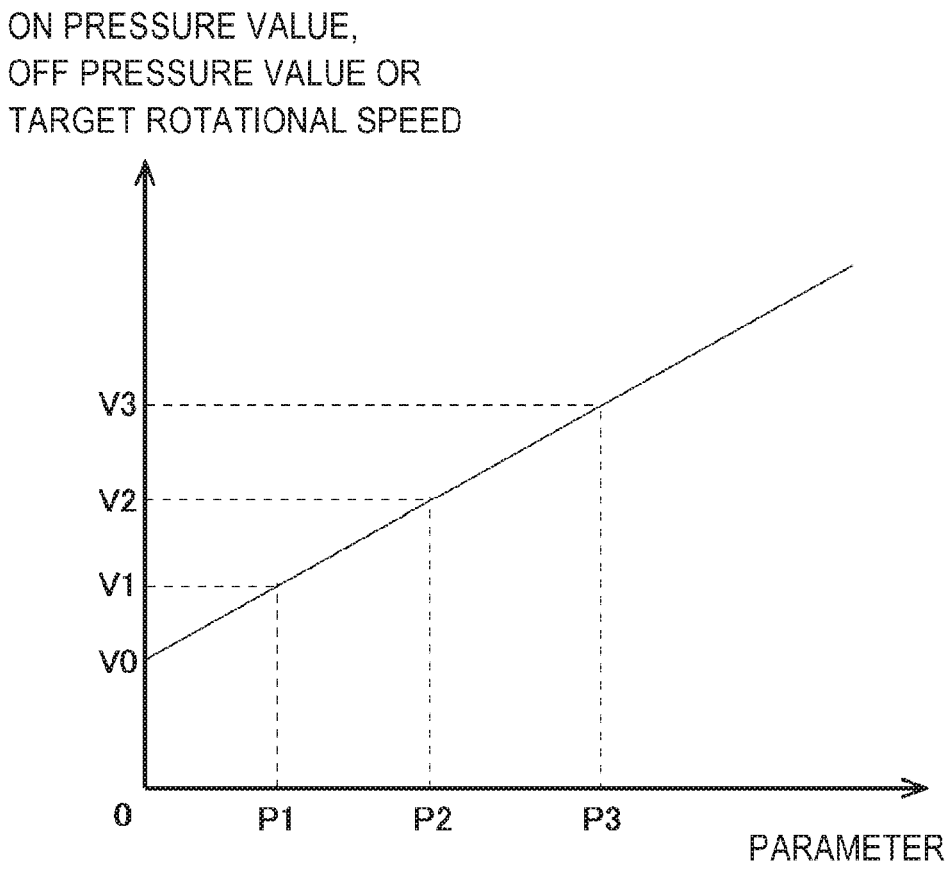
FIG. 9 is a diagram showing a relationship between a parameter and an ON pressure, an OFF pressure or a target rotational speed according to another example.

Alternatively, for example, using a relationship as shown in FIG. 9, the ON pressure value, the OFF pressure value and the value of the target rotational speed may be increased steplessly or linearly as the parameter value increases. In the example of FIG. 9, when the parameter value is "0", the ON pressure value (or the OFF pressure value or the target rotational speed) is determined to be "V0". Further, when the parameter value is "P1", the ON pressure value (or the OFF pressure value or the target rotational speed) is determined to be "V1". When the parameter value is "P2", the ON pressure value (or the OFF pressure value or the target rotational speed) is determined to be "V2". When the parameter value is "P3", the ON pressure value (or the OFF pressure value or the target rotational speed) is determined to be "V3".

For example, the parameter value "P1" is set to correspond to the amount of change in the internal pressure of the tanks 15 of 0.1 MPa (air consumption amount of about 11 liters). The parameter value "P2" is set to correspond to the amount of change in the internal pressure of the tanks 15 of 0.2 MPa (air consumption amount of about 22 liters). The parameter value "P3" is set to correspond to the amount of change in the internal pressure of the tanks 15 of 0.3 MPa (air consumption amount of about 33 liters).

For example, "V0" is set to an ON pressure value of 2.5 MPa, an OFF pressure value of 3.0 MPa and a target rotational speed of 1,600 rpm. "V1" is set to an ON pressure value of 3.0 MPa, an OFF pressure value of 3.5 MPa and a target rotational speed of 2,000 rpm. "V2" is set to an ON pressure value of 3.5 MPa, an OFF pressure value of 4.0 MPa and a target rotational speed of 2,500 rpm. "V3" is set to an ON pressure value of 3.9 MPa, an OFF pressure value of 4.4 MPa and a target rotational speed of 3,000 rpm.

In the present embodiment, although the capacity of the tanks 15 is set to 11 liters, the capacity of the tanks 15 may be increased by connecting an auxiliary tank or adding another tank 15 to increase an amount of air that can be stored. When the capacity of the tanks 15 is increased, since the air consumption amount changes with respect to the integral value of the extraction pressure (corresponding to the amount of change in the internal pressure of the tanks 15), the parameter values P1 to P3 are set based on the capacity of the tanks 15 when the capacity of the tanks 15 is changed. Further, the ON pressure value, the OFF pressure value and the rotational speed of V0 to V3 are set based on the capacity of the tanks 15.

Accordingly, in the control change processing, the control value of the motor 11 is changed in accordance with the parameter determined in the parameter determination processing. That is, the ON pressure value, the OFF pressure value and the value of the target rotational speed are changed in conjunction with the air consumption amount per unit time. Therefore, when a tool is continuously used or when a tool having large air consumption amount is used, the internal pressure of the tanks 15 is kept high, and the filling speed of compressed air is also increased by increasing the rotational speed of the motor 11. On the contrary, when the air consumption amount is small, the internal pressure of the tanks 15 is kept low, the rotational speed of the motor 11 is reduced, driving of the compression mechanism is suppressed, and a driving load can be reduced.

In the control change processing, a control current value may be changed within a range not exceeding the upper limit value of 15A in accordance with the parameter determined in the parameter determination processing. The control current value is, for example, 12A at "V0" as an initial value. As the parameter value increases due to the use of the tool having large air consumption amount and the like, the control current value is increased stepwise or steplessly to the upper limit of 15A at "V3", so that the filling speed of compressed air can be increased by increasing a driving capacity of the motor 11.

In the present embodiment, the parameter determination processing is set to be executed every 400 ms, and the control change processing is set to be executed every 2,000 ms. That is, the cycle period for executing the control change processing is set to be longer than the cycle period for executing the parameter determination processing. Accordingly, disadvantages due to frequent control changes are reduced or prevented. For example, when the ON pressure value and the OFF pressure value are frequently changed, the driving and stopping of the motor 11 may occur frequently, and discomfort of noise and vibration may increase. However, such a phenomenon can be reduced or prevented by delaying the cycle period of the control change processing as described above. Further, when the target rotational speed is changed frequently, the discomfort of noise and vibration may increase due to a frequent change in the rotational speed of the motor 11. However, such a phenomenon can be reduced or prevented by delaying the cycle period of the control change processing.

In the present embodiment, the cycle period of the control change processing is 2,000 ms, but may be changed in accordance with the parameter determined in the parameter determination processing. For example, when a parameter value reaches a predetermined threshold within a predetermined time, the controller 30 may perform control to determine that the tool having large air consumption amount is used, to change the cycle period of the control change processing to be shorter than 2,000 ms so as to increase the rotational speed of the motor 11 in a short time to increase the discharge amount of compressed air.

In the control change processing, the ON pressure value, the OFF pressure value and the value of the target rotational speed are changed in a series of flows, but it is not necessary to change these values collectively. For example, change cycle periods of these values may be different from each other, and these values may be changed by independent threads or flows.

In the control change processing, the controller 30 may compare the parameter (extraction pressure) determined in the parameter determination processing with a predetermined threshold and perform a processing of automatically switching an operation mode to change of the ON pressure value, the OFF pressure value and the target rotational speed. For example, the controller 30 may select and switch at least one of the plurality of operation modes (the first operation mode and the second operation mode in which at least one of the ON pressure value, the OFF pressure value and the target rotational speed of the motor 11 is set to different values) by referring to the extraction pressure. In this case, control can be performed such that the first operation mode is selected when the parameter is smaller than the predetermined threshold, and the second operation mode is automatically selected when the parameter is larger than the predetermined threshold. Here, a case where the number of thresholds is one and the number of operation modes to be switched is two is described, but the present invention is not limited thereto. A plurality of thresholds may be provided and three or more operation modes may be provided. Then, each time the thresholds are exceeded, the three or more operation modes may be switched stepwise.

In the parameter calculation processing according to the present embodiment, the unit time for measuring the parameter may be set to be shorter than 400 ms. As the unit time is made shorter, estimation accuracy of the air consumption amount is improved, and for example, a type of a tool may be determined.

As described above, the air compressor 10 according to the present embodiment includes the extraction pressure sensors 35 that measure the extraction pressure of the compressed air extracted from the air extraction ports, and the controller 30 controls the motor 11 by referring to the extraction pressure. Accordingly, when air is used on the tool side, the use thereof can be directly detected by the extraction pressure sensors 35. For example, the air consumption amount can be estimated based on a detection result of the extraction pressure sensors 35. Therefore, the use state of the compressed air is directly referred to and the use state of the compressed air is used for control, so that the followability of the control to the usage status of the compressed air can be improved.

Further, by using the extraction pressure sensors 35, the usage status of the compressed air can be accurately grasped without being influenced by the internal pressure of the tanks 15 that fluctuates due to factors such as the driving state of the motor 11 (whether the motor 11 is stopped), the rotational speed of the motor 11, a temperature of the air compressor 10 and a deterioration state of the air compressor 10.

Although the controller 30 calculates the air consumption amount in the present embodiment, the present invention is not limited thereto. Flow rate sensors may be configured with the extraction pressure sensors 35 to detect a flow rate of the compressed air. Even when the flow rate is used for a detected value, the driving control of the motor 11 may be performed by using the parameter determination processing and the control change processing.

(First Modified Embodiment) The control value of the motor 11 is determined using the air consumption amount as a parameter in the first embodiment described above. Instead, the control value of the motor 11 may be determined using amplitude of an extraction pressure as a parameter. A first modified embodiment in which the amplitude of the extraction pressure is used as a parameter will be described with reference to FIG. 10. Since a basic configuration of the present modified embodiment is similar to the above-described first embodiment, in order to avoid redundant description, only different parts will be described.

Figure 10:
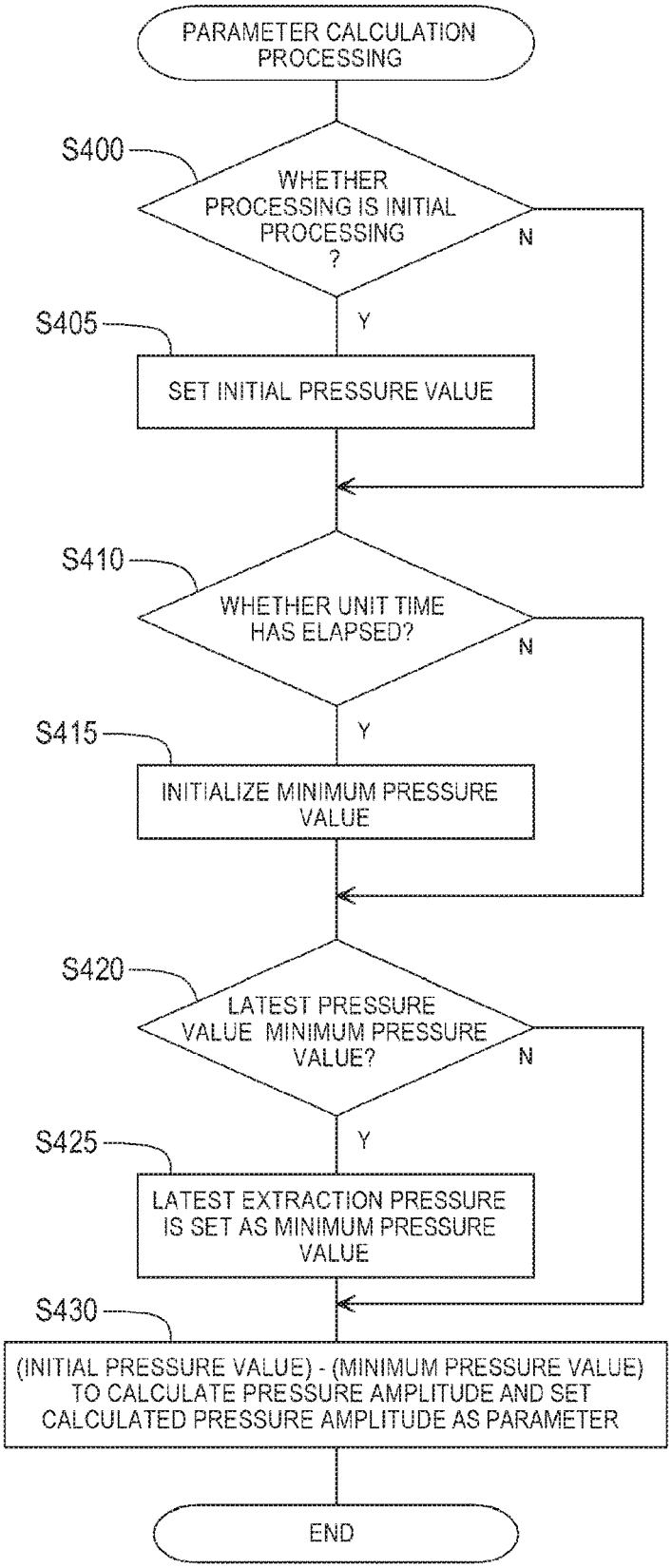
FIG. 10 is a flowchart of a parameter calculation processing according to a first modified embodiment.

In this modified embodiment, a parameter calculation processing as shown in FIG. 10 is performed instead of the parameter calculation processing according to the above-described first embodiment. In the parameter calculation processing, instantaneous air consumption amount is calculated to calculate the amplitude of the extraction pressure (amount of change in air consumption) and setting the calculated amplitude as a parameter. Therefore, the controller 30 according to the present modified embodiment changes control of the motor 11 in accordance with the amplitude of the extraction pressure calculated in the parameter calculation processing.

In the parameter calculation processing, first, in step S400 shown in FIG. 10, it is checked whether the processing is an initial processing (whether an initial pressure value is set). When the processing is the initial processing, the processing proceeds to step S405. On the other hand, when the processing is not the initial processing, the processing proceeds to step S410.

When the processing proceeds to step S405, it is determined that a current extraction pressure detected by the extraction pressure sensors 35 is an extraction pressure in an unused state where a tool is not operated, and the current extraction pressure is set as the initial pressure value. Then, the processing proceeds to step S410.

In step S410, it is checked whether a unit time for measuring a parameter has elapsed. That is, in the parameter calculation processing according to the present modified embodiment, since the amplitude of the extraction pressure per unit time is calculated and used as a parameter, a minimum pressure value, which is a minimum value of the extraction pressure per unit time, is periodically reset. When the unit time has elapsed, the processing proceeds to step S415. On the other hand, when the unit time has not elapsed, the processing proceeds to step S420.

When the processing proceeds to step S415, the minimum pressure value is reset to the initial pressure value (reset such that the amplitude of the extraction pressure is "0"). Then, the processing proceeds to step S420.

In step S420, a latest extraction pressure is compared with the minimum pressure value. When the latest extraction pressure is smaller than the minimum pressure value, the processing proceeds to step S425 to update the minimum pressure value. On the other hand, when the latest extraction pressure is not smaller than the minimum pressure value, the processing proceeds to step S430.

When the processing proceeds to step S425, the latest extraction pressure is set as the minimum pressure value. Then, the processing proceeds to step S430.

In step S430, the minimum pressure value is subtracted from the initial pressure value so as to calculate the pressure amplitude per unit time (amount of change in a pressure) and set the calculated pressure amplitude as a parameter. Then, the processing ends.

Thus, the parameter calculation processing according to the present modified embodiment ends. The parameter calculated in the parameter calculation processing is used in a control change processing similar to that of FIG. 7 described above. Accordingly, the control of the motor 11 can be changed using the amplitude of the extraction pressure as a parameter.

Even in the configuration according to such a modified embodiment, since the motor 11 can be controlled using the extraction pressure, followability of control to a usage status of compressed air can be improved. Further, the usage status of compressed air can be accurately grasped without being influenced by an internal pressure of the tanks 15.

(Second Modified Embodiment) The control value of the motor 11 is determined using the air consumption amount as a parameter in the above-described first embodiment. Instead, the control value of the motor 11 may be determined using usage times of air (usage times of a tool) as a parameter. For example, when a driving tool is used, the control value of the motor 11 may be determined using driving times of the tool as a parameter. A second modified embodiment in which the usage times of air is used as a parameter will be described with reference to FIG. 11. Since a basic configuration of the present modified embodiment is similar to the above-described first embodiment, in order to avoid redundant description, only different parts will be described.

Figure 11:
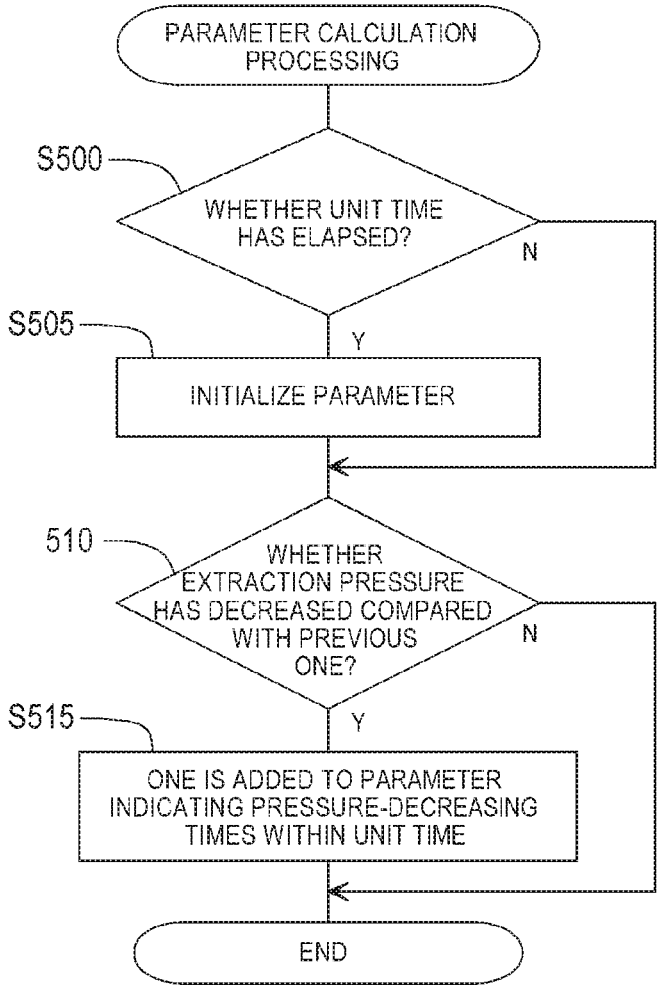
FIG. 11 is a flowchart of a parameter calculation processing according to a second modified embodiment.

In this modified embodiment, a parameter calculation processing as shown in FIG. 11 is performed instead of the parameter calculation processing according to the first embodiment described above. In the parameter calculation processing, a change rate (inclination) of a pressure change of an extraction pressure per unit time is calculated. In the present modified embodiment, pressure-decreasing times per unit time is counted based on increase/decrease in the change rate of the pressure change so at to calculate the usage times of air and set the calculated usage times of air as a parameter. Therefore, the controller 30 according to the present modified embodiment changes control of the motor 11 in accordance with the usage times of air calculated in the parameter calculation processing.

In the parameter calculation processing, first, in step S500 shown in FIG. 11, it is checked whether a unit time for measuring a parameter has elapsed. That is, in the parameter calculation processing according to the present modified embodiment, since the usage times of air per unit time is calculated as a parameter, the parameter is periodically reset. When the unit time has elapsed, the processing proceeds to step S505. On the other hand, when the unit time has not elapsed, the processing proceeds to step S510.

When the processing proceeds to step S505, the parameter (that is, the usage times of air) is reset to "0". Then, the processing proceeds to step S510.

In step S510, a latest extraction pressure is compared with an extraction pressure used in a previous parameter calculation processing (previous extraction pressure), and it is checked whether the extraction pressure has decreased. When the extraction pressure has decreased, it is determined that compressed air is used on a tool side, and the processing proceeds to step S515. On the other hand, when the extraction pressure has not decreased, it is determined that compressed air is not used on the tool side, and the processing ends.

When the check in step S510 ends, the latest extraction pressure is saved as the "previous extraction pressure". Accordingly, the "previous extraction pressure" may be referred to in a next parameter calculation processing.

When the processing proceeds to step S515, one is added to the parameter. Then, the processing ends.

Thus, the parameter calculation processing according to the present modified embodiment ends. The parameter calculated in the parameter calculation processing is used in a control change processing similar to that of FIG. 7 described above. Accordingly, the control of the motor 11 can be changed using the usage times of air as a parameter.

Even in the configuration according to such a modified embodiment, since the motor 11 can be controlled using the extraction pressure, followability of control to a usage status of compressed air can be improved. Further, the usage status of compressed air can be accurately grasped without being influenced by an internal pressure of the tanks 15.

(Third Modified Embodiment) The control value of the motor 11 is determined using the air consumption amount as a parameter in the above-describe first embodiment. Instead, a parameter may be set based on a pressure difference between an internal pressure of the tanks 15 and an extraction pressure, and the control value of the motor 11 may be determined by referring to the parameter. That is, a state where the difference between the internal pressure of the tanks 15 and the extraction pressure is large is a state where a remaining amount of compressed air has some margin. Conversely, a state where the difference between the internal pressure of the tanks 15 and the extraction pressure is small is a state where the remaining amount of compressed air has no margin. Therefore, the control value of the motor 11 may be determined based on those state changes. A third modified embodiment in which the pressure difference between the internal pressure of the tanks 15 and the extraction pressure is used as a parameter will be described with reference to FIG. 12. Since a basic configuration of the present modified embodiment is similar to the above-described first embodiment, in order to avoid redundant description, only different parts will be described.

Figure 12:
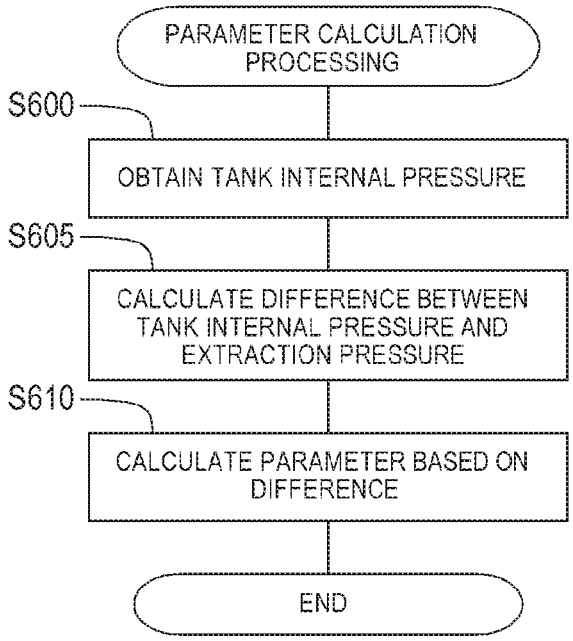
FIG. 12 is a flowchart of a parameter calculation processing according to a third modified embodiment.

In this modified embodiment, a parameter calculation processing as shown in FIG. 12 is performed instead of the parameter calculation processing according to the above-described first embodiment. In the parameter calculation processing, a parameter is calculated based on the pressure difference between the internal pressure of the tanks 15 and the extraction pressure.

In the parameter calculation processing, first, in step S600 shown in FIG. 12, the internal pressure of the tanks 15 is obtained from the pressure sensor 34. Then, the processing proceeds to step S605.

In step S605, the pressure difference between the internal pressure of the tanks 15 and the extraction pressure is calculated (the extraction pressure is subtracted from the internal pressure of the tanks 15). Then, the processing proceeds to step S610.

In step S610, a parameter is calculated based on the pressure difference calculated in step S605. As the parameter, the pressure difference may be used at it is, or a value obtained by converting the pressure difference by using a predetermined conversion table or a conversion formula may be used. Then, the processing ends.

Thus, the parameter calculation processing according to the present modified embodiment ends. The parameter calculated in the parameter calculation processing is used in a control change processing similar to that of FIG. 7 described above. Accordingly, control of the motor 11 can be changed based on the pressure difference between the internal pressure of the tanks 15 and the extraction pressure.

(Fourth Modified Embodiment) Although not particularly described in the first embodiment and the modified embodiments described above, the user may be notified of a pressure decrease based on the extraction pressure measured by the extraction pressure sensors 35.

Figure 13:
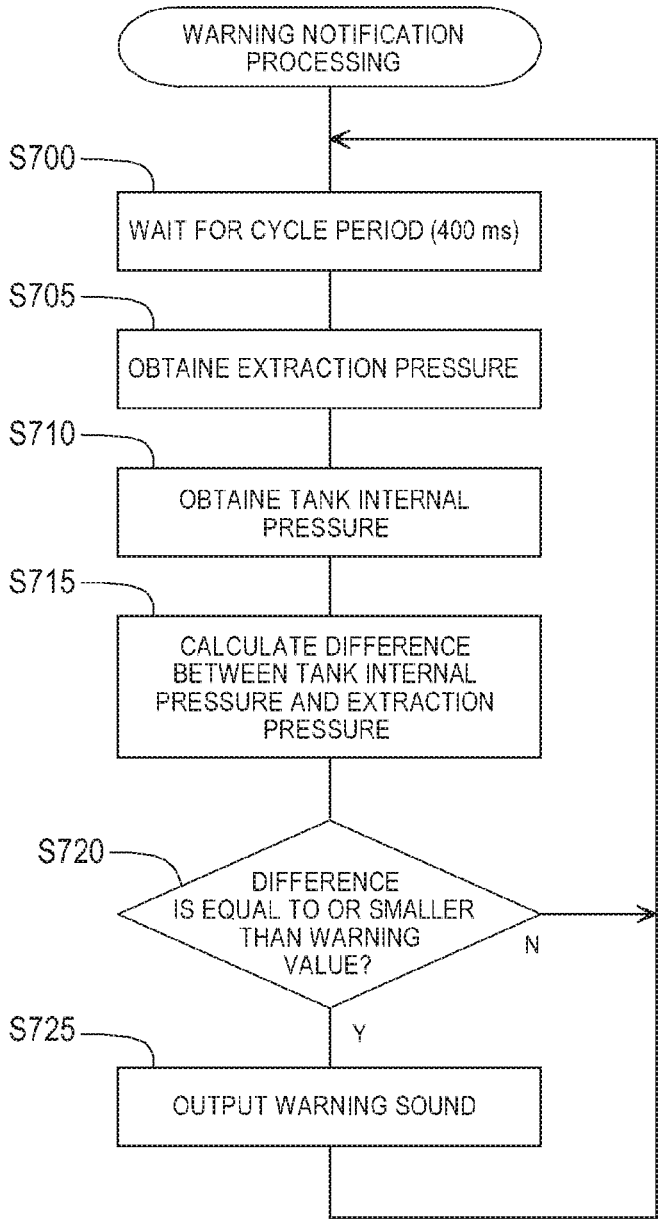
FIG. 13 is a flowchart of an error determination processing according to a fourth modified embodiment.

For example, a warning notification processing as shown in FIG. 13 may be executed. In the warning notification processing, when a pressure difference between an internal pressure of the tanks 15 and the extraction pressure is equal to or smaller than a predetermined threshold, the user is notified of a warning by using the display unit 32 and the sound generation device 33.

In the warning notification processing, first, in step S700 shown in FIG. 13, the processing waits until a cycle period for executing the processing arrives. Since the warning notification processing according to the present embodiment is periodically executed every 400 ms, the processing waits until 400 ms has elapsed from previous execution. Then, the processing proceeds to step S705.

In step S705, the extraction pressure detected by the extraction pressure sensors 35 is obtained. Then, the processing proceeds to step S710.

In step S710, the internal pressure of the tanks 15 detected by the pressure sensor 34 is obtained. Then, the processing proceeds to step S715.

In step S715, the pressure difference between the internal pressure of the tanks 15 and the extraction pressure is calculated (the extraction pressure is subtracted from the internal pressure of the tanks 15). Then, the processing proceeds to step S720.

In step S720, it is checked whether the pressure difference calculated in step S715 is equal to or smaller than a predetermined warning value. When the pressure difference is equal to or smaller than the warning value, the processing proceeds to step S725. On the other hand, when the pressure difference is not equal to or smaller than the warning value, one warning notification processing ends. That is, the processing returns to step S700 and waits until a next warning notification processing starts.

When the processing proceeds to step S725, since the pressure difference between the internal pressure of the tanks 15 and the extraction pressure is small, it is determined that compressed air in the tanks 15 is not sufficient. Therefore, a warning sound is output using the sound generation device 33 and the user is notified. At this time, information related to the warning may be displayed on the display unit 32 (LED or liquid crystal). Thus, one warning notification processing ends. That is, the processing returns to step S700 and waits until a next warning notification processing starts.

When such a warning notification processing is executed, a tool connected to the air compressor 10 can be prevented from being used beforehand in a state where the internal pressure of the tanks 15 is not sufficient.

In the warning notification processing, notification is performed when the pressure difference between the internal pressure of the tanks 15 and the extraction pressure is equal to or smaller than a predetermined threshold. However, the present invention is not limited thereto.

For example, when the extraction pressure measured by the extraction pressure sensors 35 is equal to or smaller than a predetermined threshold, the user may be notified using the display unit 32 and the sound generation device 33.

When air consumption amount estimated from a detection result by the extraction pressure sensors 35 (refer to the first embodiment) exceeds a predetermined threshold, the user may be notified using the display unit 32 and the sound generation device 33.

(Fifth Modified Embodiment) In the above-described embodiments, the extraction pressure sensors 35 are arranged between the decompression valves 16*a* and 16*b* and the air extraction ports, and consumption of compressed air by the tool connected to the air hose is detected by the extraction pressure sensors 35. Instead, the extraction pressure sensors 35 may be provided on the tool side such as a nail driving machine or an air duster, or on the air hose.

For example, a sensor unit may be used which includes the extraction pressure sensors 35, a battery serving as a power supply unit and a wireless communication module serving as a communication unit, and the sensor unit may be attached to the tool or the air hose. Then, the air compressor 10 may be provided with an antenna for receiving a signal from the wireless communication module, so that an extraction pressure detected by the extraction pressure sensors 35 can be received by the air compressor 10. The air compressor 10 that has received the signal from the extraction pressure sensors 35 (that is, has obtained the extraction pressure) may perform, based on the flows described above, the parameter determination processing and the control change processing with the controller 30.

(Sixth Modified Embodiment) In addition to the configuration in the above-described embodiments, or instead of a part of the configuration in the above-described embodiment, a processing related to driving control of the motor 11 may be changed by determining a type of a tool connected to an air hose.

Here, when an extraction pressure detected by the extraction pressure sensors 35 is used, the type of the tool connected to the air hose can be determined.

Figure 14:
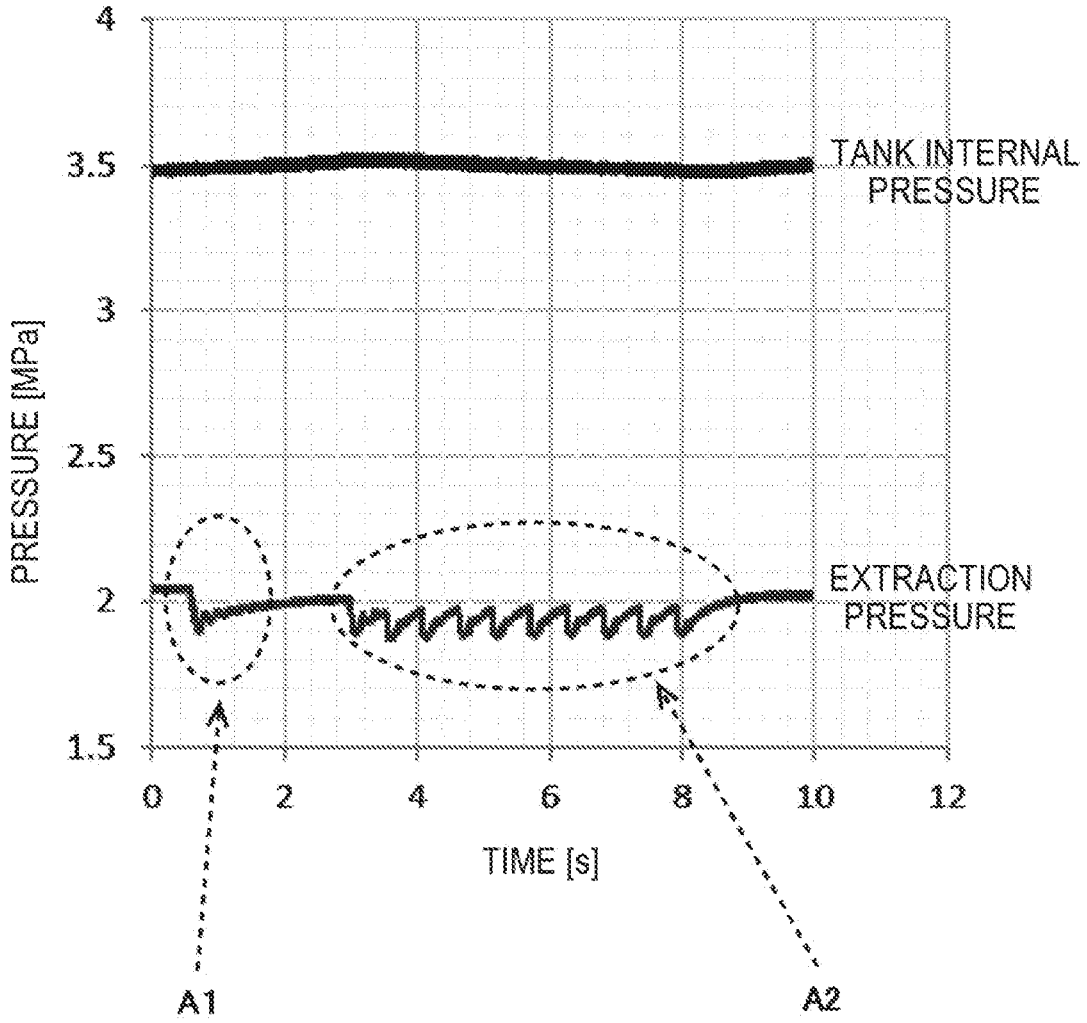
FIG. 14 is a diagram for illustrating a processing according to a sixth modified embodiment and showing a tank internal pressure and an extraction pressure during use of a nail driving machine.

For example, FIG. 14 is a graph showing an internal pressure of the tanks 15 and an extraction pressure during use of a nail driving machine. As shown in the graph, when the nail driving machine is connected to the air extraction port of the air compressor 10, a change in the extraction pressure as indicated by A1 (waveform that restores after a sudden pressure decrease) is generated. Further, when the nail driving machine is used (that is, when a nail driving operation is performed), a waveform of an intermittent change in the extraction pressure as shown in A2 is generated.

Figure 15:
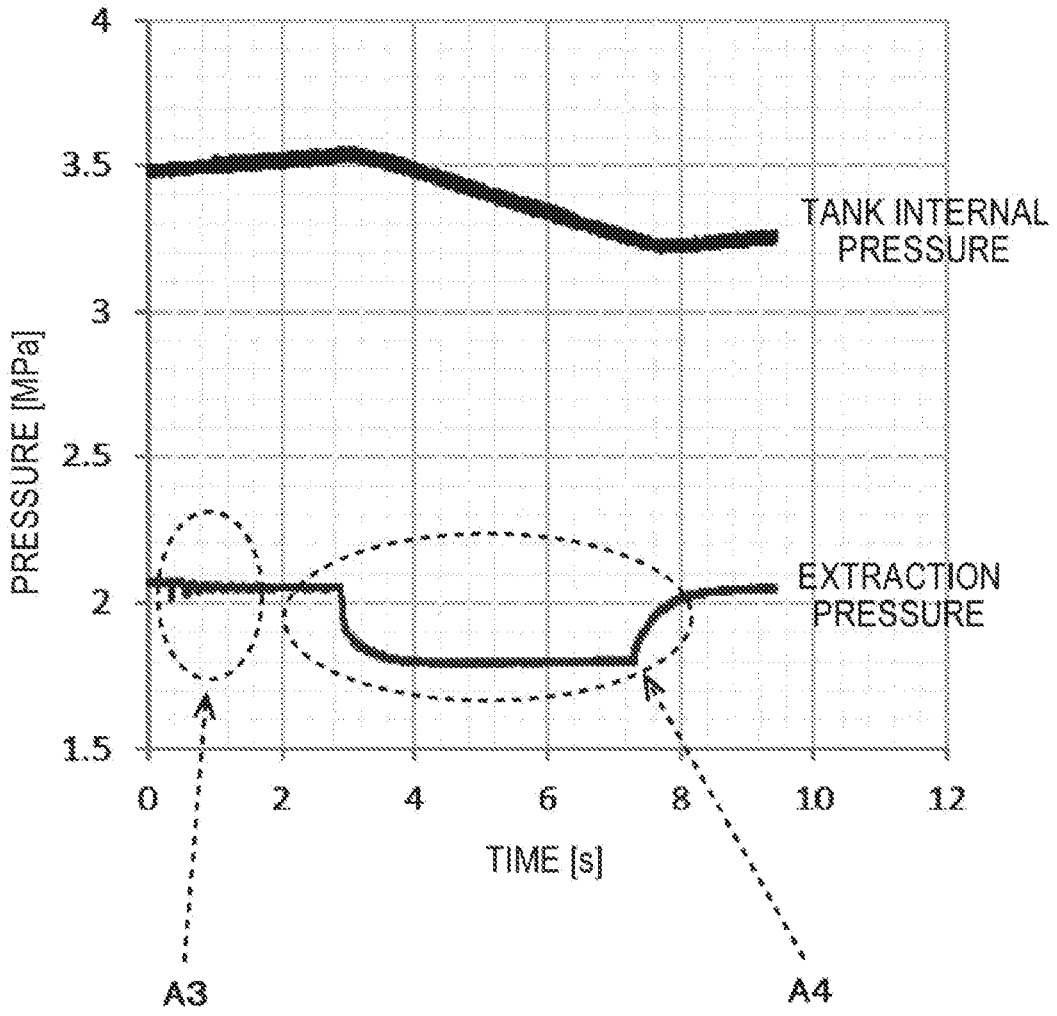
FIG. 15 is a diagram for illustrating a processing according to the sixth modified embodiment and showing a tank internal pressure and an extraction pressure during use of an air duster.

FIG. 15 is a graph showing an internal pressure of the tanks 15 and an extraction pressure during use of the air duster. As shown in the graph, when the air duster is connected to the air extraction port of the air compressor 10, a change in the extraction pressure as indicated by A3 (fine waveform compared with that of the nail driving machine) is generated. Further, when the air duster is used, a change in the extraction pressure as indicated by A4 (waveform of a continuous pressure decrease) is generated.

Accordingly, the change in the extraction pressure is analyzed, so that a change in a waveform that cannot be determined from the internal pressure of the tanks 15 can be detected. That is, a change pattern of a waveform of each tool is stored in advance as data in the controller 30 of the air compressor 10, and the pattern is compared with a waveform that actually appears. Accordingly, a type of a tool connected to the air compressor 10 can be determined.

As described above, in the parameter calculation processing, a unit time for measuring a parameter is made shorter than 400 ms (in a short time), so that detection accuracy of the extraction pressure is improved. The type of the tool can be determined by detecting a change in a waveform.

The type of the tool determined in this way is reflected in a processing of the controller 30.

For example, the target rotational speed of the motor 11, the ON pressure value, the OFF pressure value and the like may be changed based on the type of the tool.

A cycle period of the control change processing may be changed based on the type of the tool. For example, when it is determined that the type of the tool is an "air duster", since air consumption amount of the air duster is large, the cycle period of the control change processing may be shortened to be shorter than 2,000 ms, control may be performed to increase the rotational speed of the motor 11 in a short time to increase discharge amount of compressed air.

The invention claimed is:

1. An air compressor comprising:
a motor;
a compression mechanism configured to be driven by the motor to generate compressed air;
a tank configured to store the compressed air;
a controller configured to control driving of the motor;
a decompression valve provided to the tank;
an air extraction port downstream from the decompression valve and configured to extract compressed air decompressed by passing through the decompression valve from the tank; and
an extraction pressure sensor configured to measure an extraction pressure that is a pressure of compressed air extracted from the air extraction port,
wherein the controller is configured to control the driving of the motor by referring to the extraction pressure.

2. The air compressor according to claim 1,
wherein the controller is configured to change a rotational speed of the motor by referring to the extraction pressure.

3. The air compressor according to claim 1,
wherein the controller is configured to change a control current value of the motor by referring to the extraction pressure.

4. The air compressor according to claim 1,
wherein the controller is configured to estimate air consumption amount based on a time-integral value of the extraction pressure and to change control of the motor in accordance with the air consumption amount.

5. The air compressor according to claim 1,
wherein the controller is configured to estimate a flow rate of compressed air based on the extraction pressure and to change control of the motor in accordance with the flow rate of compressed air.

6. The air compressor according to claim 1,
wherein the controller is configured to estimate air consumption amount based on a change rate of the extraction pressure per unit time and to change control of the motor in accordance with the air consumption amount.

7. The air compressor according to claim 1,
wherein the controller is configured to periodically execute
a parameter determination processing of determining a parameter for controlling the motor by referring to the extraction pressure, and
a control change processing of changing control of the motor by using the parameter, and
wherein a cycle period for executing the control change processing is set to be longer than a cycle period for executing the parameter determination processing.

8. The air compressor according to claim 1, wherein the extraction pressure sensor is positioned between the decompression valve and the air extraction port.

9. An air compressor comprising:
a motor;
a compression mechanism configured to be driven by the motor to generate compressed air;
a tank configured to store the compressed air;
a controller configured to control driving of the motor;
a decompression valve provided to the tank;
an air extraction port downstream from the decompression valve and configured to extract compressed air decompressed by passing through the decompression valve from the tank; and
an extraction pressure sensor configured to measure an extraction pressure that is a pressure of compressed air extracted from the air extraction port,
wherein the controller is configured to control the driving of the motor by referring to the extraction pressure,
wherein the controller is configured to perform control to drive the motor when an internal pressure of the tank is equal to or lower than a predetermined ON pressure value that is a pressure value for restarting the motor and to stop the motor when the internal pressure of the tank is equal to or higher than a predetermined OFF pressure value that is a pressure value for stopping the motor, and
wherein the controller is configured to change at least one of the ON pressure value and the OFF pressure value by referring to the extraction pressure.

10. An air compressor comprising:
a motor;
a compression mechanism configured to be driven by the motor to generate compressed air;
a tank configured to store the compressed air;
a controller configured to control driving of the motor;
a decompression valve provided to the tank;
an air extraction port downstream from the decompression valve and configured to extract compressed air decompressed by passing through the decompression valve from the tank; and
an extraction pressure sensor configured to measure an extraction pressure that is a pressure of compressed air extracted from the air extraction port,
wherein the controller is configured to control the driving of the motor by referring to the extraction pressure,
wherein the controller is configured to perform control to drive the motor when an internal pressure of the tank is equal to or lower than a predetermined ON pressure value that is a pressure value for restarting the motor and to stop the motor when the internal pressure of the tank is equal to or higher than a predetermined OFF pressure value that is a pressure value for stopping the motor,
wherein the controller has a plurality of operation modes in which at least one of the ON pressure value, the OFF pressure value and a target rotational speed of the motor is set to different values, and
wherein the controller is configured to execute a processing of automatically switching the operation modes by referring to the extraction pressure.

* * * * *